US009850062B2

(12) United States Patent
Mariano

(10) Patent No.: US 9,850,062 B2
(45) Date of Patent: Dec. 26, 2017

(54) PACKAGING WITH DOUBLE COLLAR LID

(71) Applicant: Apple Inc., Cupertino, CA (US)

(72) Inventor: Ricardo Alba Mariano, Hayward, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/018,437

(22) Filed: Feb. 8, 2016

(65) Prior Publication Data

US 2017/0088342 A1 Mar. 30, 2017

Related U.S. Application Data

(60) Provisional application No. 62/235,317, filed on Sep. 30, 2015.

(51) Int. Cl.

| | |
|---|---|
| ***B65D 85/30*** | (2006.01) |
| ***B65D 25/10*** | (2006.01) |
| ***B65D 43/02*** | (2006.01) |
| ***B65D 81/05*** | (2006.01) |

(52) U.S. Cl.

CPC ..... *B65D 85/30* (2013.01); *B65D 25/10* (2013.01); *B65D 43/02* (2013.01); *B65D 81/05* (2013.01)

(58) Field of Classification Search

CPC ..... B65D 25/10; B65D 43/02; B65D 43/08; B65D 85/30; B65D 81/05; H05K 5/00

USPC ..... 206/320; 220/4.21, 4.24, 4.26, 4.27; 229/122.32, 122.34, 125.01; 361/679.55

See application file for complete search history.

(56) References Cited

U.S. PATENT DOCUMENTS

| | | | | |
|---|---|---|---|---|
| 2,367,520 A * | 1/1945 | Patek | B65D 3/22 | 229/122.32 |
| 4,405,057 A | 9/1983 | Stein | | |
| 4,854,476 A * | 8/1989 | Serio, Jr. | B65D 53/02 | 220/4.21 |
| 4,932,554 A | 6/1990 | Smith et al. | | |
| 5,515,240 A * | 5/1996 | Rodeffer | H05K 5/0013 | 220/4.21 |
| 6,315,142 B1 * | 11/2001 | Kitamura | H04M 1/0252 | 220/4.26 |
| 6,359,218 B1 * | 3/2002 | Koch | H05K 5/0021 | 220/4.26 |
| 8,164,899 B2 * | 4/2012 | Yamaguchi | G06F 1/1616 | 220/4.21 |
| 8,596,449 B2 * | 12/2013 | Mongan | A45C 11/182 | 206/320 |
| 2001/0052521 A1 * | 12/2001 | Goyal | H05K 5/0013 | 220/4.21 |

* cited by examiner

*Primary Examiner* — Bryon Gehman
(74) *Attorney, Agent, or Firm* — Sterne, Kessler, Goldstein & Fox P.L.L.C.

(57) ABSTRACT

Packaging with a double collar lid may be used for any type of consumer product, including electronic devices. The packaging includes a base, a tray disposed within the base, and a lid comprising an outer portion and a first inner collar. The tray is configured to support an electronic device to be raised relative to a bottom of the base with an available area for the electronic device disposed above a top of the base. The first inner collar is configured to constrain the position of the electronic device within the available area such that when the lid is removed from the base the electronic device is framed by the tray.

26 Claims, 19 Drawing Sheets

PACKAGING WITH DOUBLE COLLAR LID

CROSS-REFERENCE TO RELATED APPLICATION(S)

This application claims priority to U.S. Provisional Application No. 62/235,317, filed on Sep. 30, 2015, which is incorporated herein in its entirety by reference thereto.

FIELD

The described embodiments relate generally to packaging and specifically to packaging with a double collar lid.

BACKGROUND

Packaging may be used for electronic products for shipping or presentation to a consumer.

SUMMARY

The present disclosure details systems, apparatuses, and methods related to packaging with a double collar lid. A package for an electronic device may include a base, a tray disposed within the base and configured to support the electronic device to be raised relative to a bottom of the base, wherein an available area for the electronic device is disposed above a top of the base, and a lid comprising an outer portion and a first inner collar configured to constrain the position of the electronic device within the available area such that when the lid is removed from the base the electronic device is framed by the tray.

In some embodiments, at least one half of the available area for the electronic device is disposed above the top of the base.

In some embodiments, the outer portion comprises a top, and the distance between the top of the outer portion and the tray is at least twice the distance between the top of the base and the tray. In some embodiments, the outer portion comprises a top, and a distance between the top of the outer portion and the tray is equal to a height of the first inner collar. In some embodiments, the packaging further comprises a second inner collar disposed between the outer portion and the first inner collar. In some embodiments, the outer portion comprises a top, and a distance between the top of the outer portion and the top of the base is equal to a height of the second inner collar.

In some embodiments, at least one of the first and second inner collars comprises a thickness that is equal to or greater than a thickness of a side of the base. In some embodiments, each of the first and second inner collars comprises a thickness, and the thickness of one of the first and second inner collars is at least two millimeters.

In some embodiments, the first inner collar is configured to horizontally constrain the position of the electronic device and the second inner collar comprises a vertical stop for the lid with respect to the base. In some embodiments, the first inner collar comprises a height that is at least half of a height of a side of the base. In some embodiments, the first inner collar is configured to constrain the position of the electronic device as the lid is being removed from the base.

In some embodiments, the tray and the base form a cavity underneath the tray.

In some embodiments, a packaged electronic device includes the package according to some embodiments and the electronic device, wherein the electronic device is a computer mouse. In some embodiments, a packaged electronic device includes the package according to some embodiments and the electronic device, wherein the electronic device is a phone.

In some embodiments, a packaged electronic device includes the package according to some embodiments and the electronic device, wherein the electronic device is closely adjacent to the first inner collar. In some embodiments, a packaged electronic device includes the package according to some embodiments and the electronic device, wherein the outer portion comprises a top, and wherein the electronic device is closely adjacent to the top.

In some embodiments, a lid includes a top, a side wall connected to the top, a first collar disposed on an inner surface of the side wall adjacent to the top, and a second collar disposed on an inner surface of the first collar adjacent to the top, wherein the second collar extends further away from the top than the first collar.

In some embodiments, the side wall comprises four side wall segments. In some embodiments, the first collar is adhered to the inner surface of the side wall. In some embodiments, the second collar is adhered to the inner surface of the first collar.

In some embodiments, the side wall extends further away from the top than does the second collar. In some embodiments, the first collar is in contact with the top. In some embodiments, the second collar is in contact with the top.

In some embodiments, a package for an electronic device includes a base, and a lid configured to interface with the base to close the package that includes a top, a side wall connected to the top, wherein the side wall is disposed on an outside of the base when the package is closed, a first collar disposed on an inner surface of the side wall adjacent the top, wherein the first collar abuts the base when the package is closed, and a second collar disposed on an inner surface of the first collar adjacent the top, wherein the second collar is disposed on an inside of the base when the package is closed.

In some embodiments, the side wall extends to a bottom of the base when the package is closed. In some embodiments, the package also includes a layer of protective material forming an inner surface of the top. In some embodiments, the package also includes the electronic device disposed within the package, wherein the second collar is configured to constrain the position of the electronic device when the package is closed.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
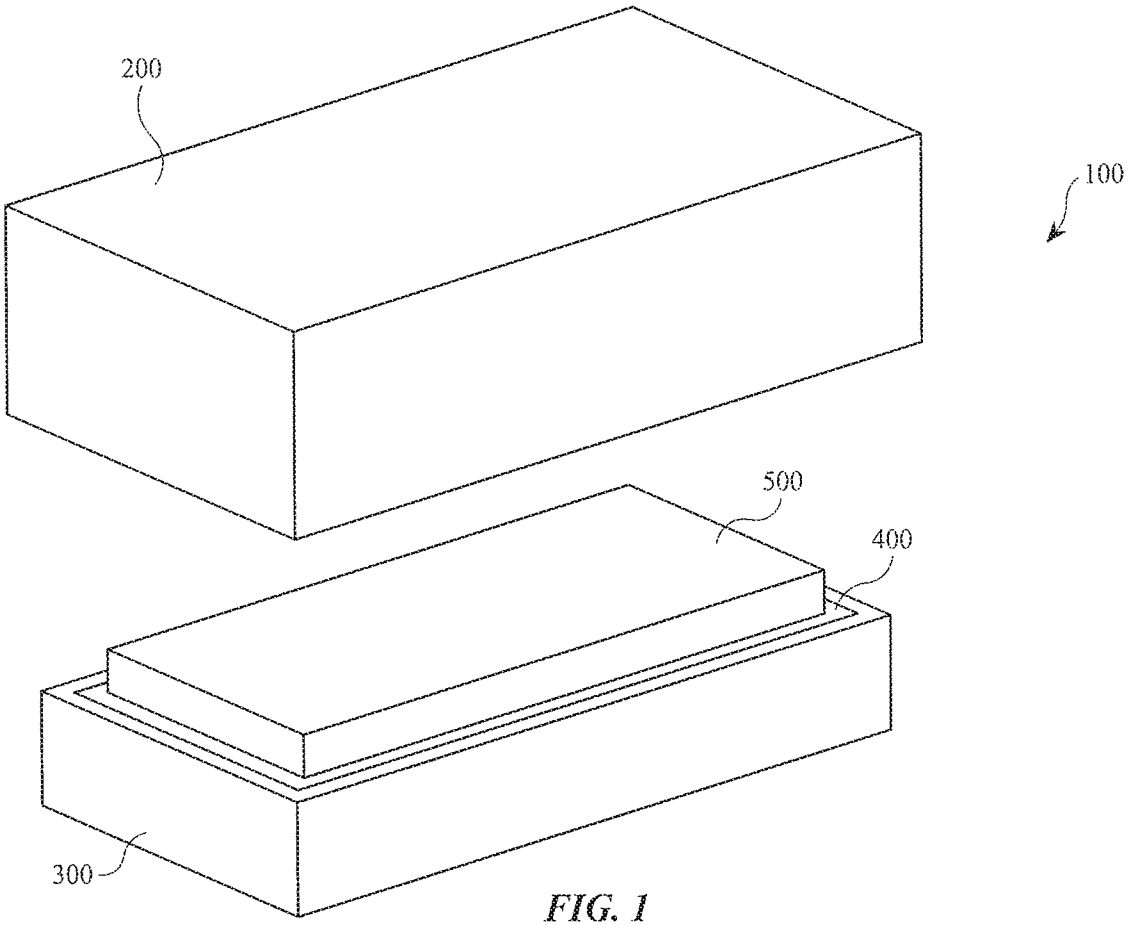
FIG. 1 shows a perspective view of packaging with a double collar lid according to some embodiments.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the claims.

A consumer's first experience with a product after purchase is related to the product's packaging and the removal of the product from the packaging. Packaging may be used to protect the product during shipping and handling. Packaging may also be used to present the product to the customer in a pleasing way. While it is desirable to protect the product, it is also desirable to configure the packaging so that the product is easily accessible when the consumer is ready to remove the packaging and use the product.

The following disclosure relates to packaging with a double collar lid. Packaging according to embodiments of the present invention may be used for any type of consumer product, including electronic devices. For example, the packaging disclosed herein may be used for a computer mouse, smart phone, tablet, computer, and the like.

In some embodiments, packaging may include a lid, a base box, and a tray. The lid may include an outer portion and two collars disposed within the outer portion. The base box may also include an outer portion and a collar disposed within the outer portion. The tray is configured to rest upon the collar of the base box and support the product within the packaging. Thus, the product is raised up relative to the base box to be presented to the consumer immediately upon removing the lid from the base box in a designated space. The designated space presents the product in an aesthetically pleasing way. For example, the tray may provide a frame around the product. In this configuration, an available area for the electronic device extends above a top of the base. Thus, a portion of the product may be raised above the top of the base box. Thus, the consumer can immediately and easily remove the product from the packaging and begin using the product.

Presenting the product in this fashion, while convenient and beneficial for presentation and accessibility, introduces challenges with protecting the product prior to use. For example, during shipping or upon handling in retail stores, packaging may drop and experience other movements that can tend to cause movement of a product within packaging. Accordingly, the double collar lid as described herein can provide stability and protection to the product while the product is within the packaging.

In some embodiments, when the lid is on the base box, the outer portion of the double collar lid is disposed outside of the outer portion of the base box, one of the two collars of the lid abuts with the outer portion of the base box, and the other of the two collars is disposed on the inside of the outer portion of the base box. The product is disposed closely adjacent to the second collar to minimize movement of the product within the packaging.

These and other embodiments are discussed below with reference to the figures. However, those skilled in the art will readily appreciate that the detailed description given herein with respect to these figures is for explanatory purposes only and should not be construed as limiting.

FIG. 1 is a perspective view showing packaging 100 according to some embodiments. Packaging 100 may be configured to package a variety of products. For example, packaging 100 may package an electronic device, including, but not limited to, a computer mouse, phone, tablet, computer, or watch. Accordingly, packaging 100 may be shaped and sized to accommodate the particular device being packaged. Packaging 100 may be a rectangular box, as shown, or it may be a circular box, square box, or any other suitably shaped box.

Figure 2:
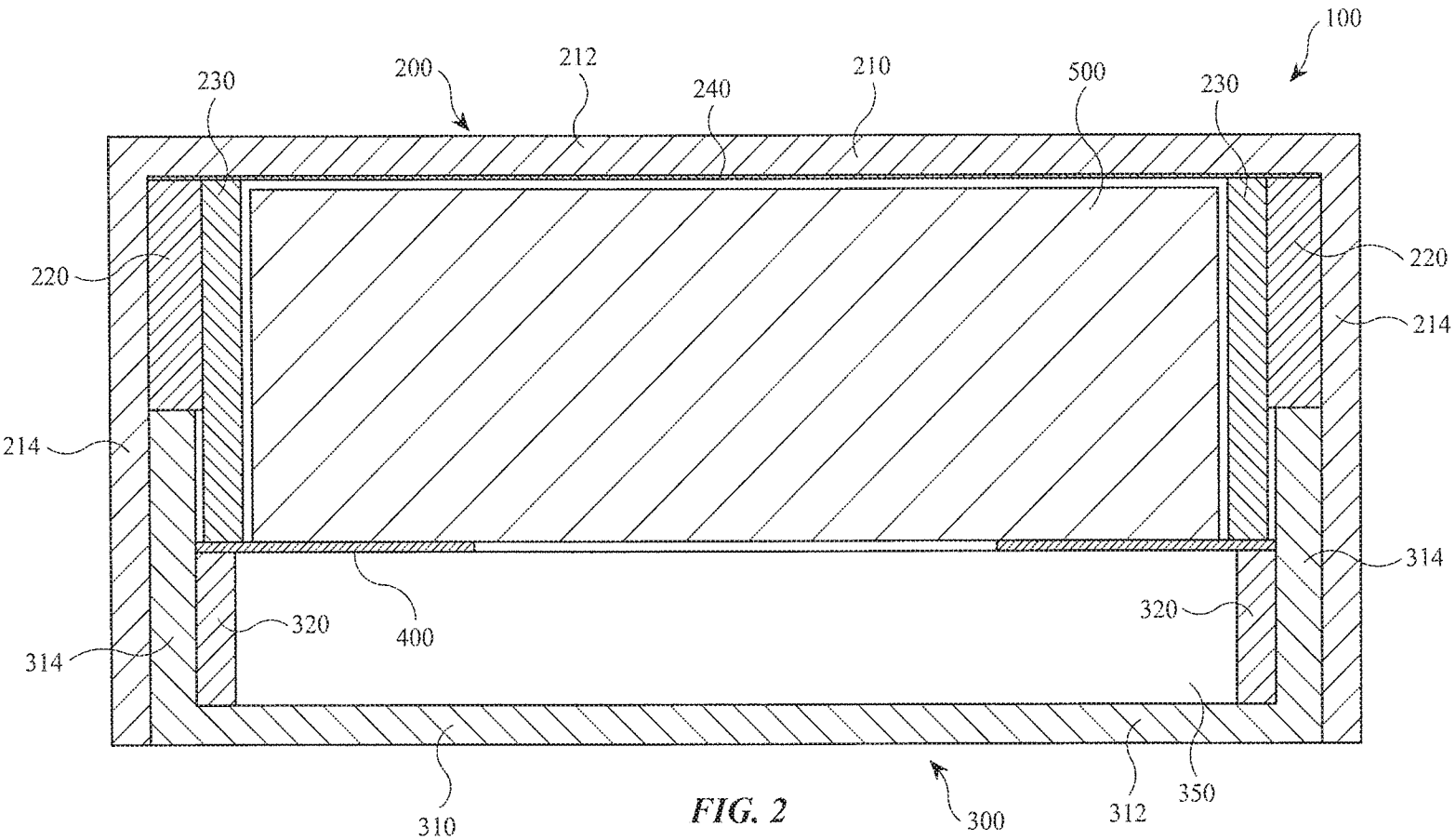
FIG. 2 shows a cross-section view of packaging with a double collar lid according to some embodiments.
Figure 3:
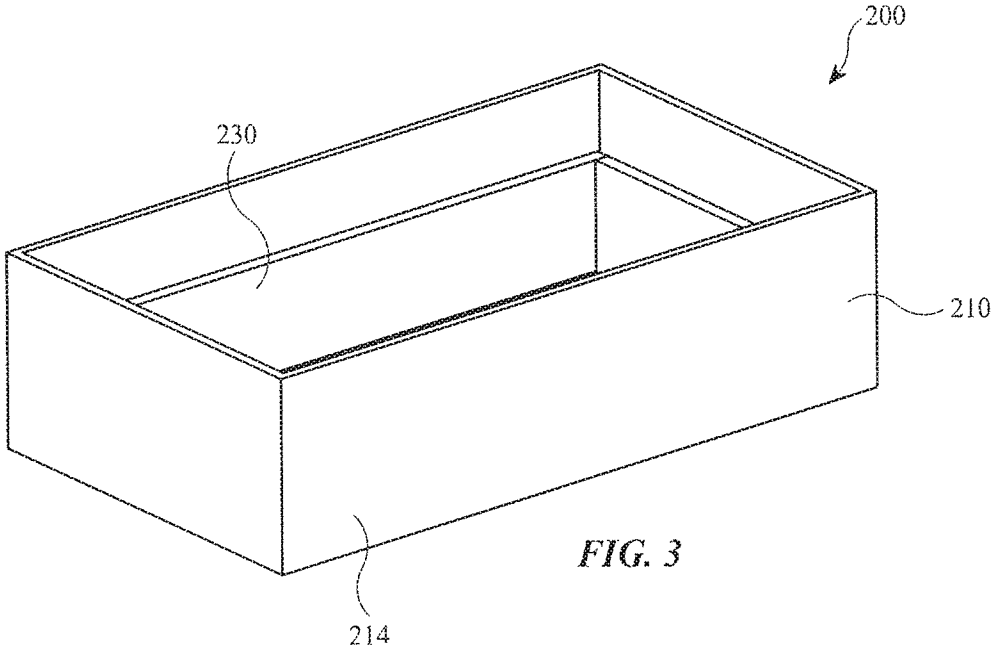
FIG. 3 shows a perspective view of a double collar lid according to some embodiments.
Figure 4:
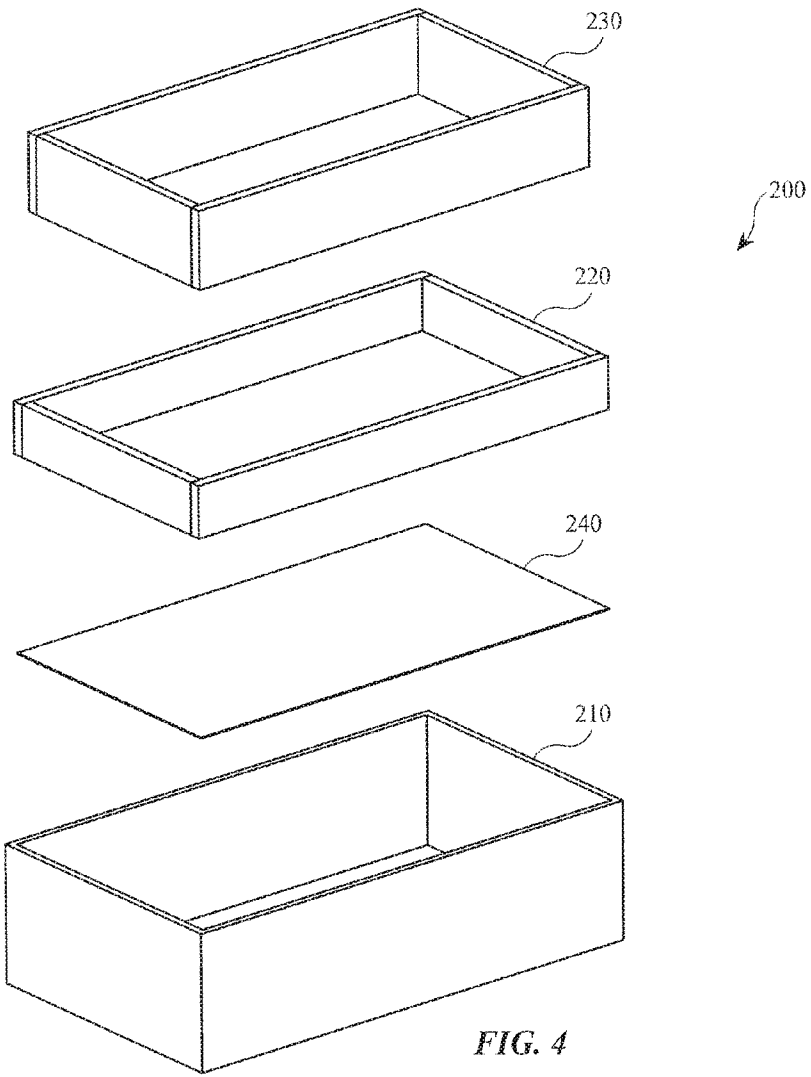
FIG. 4 shows an exploded view of a double collar lid according to some embodiments.
Figure 5:
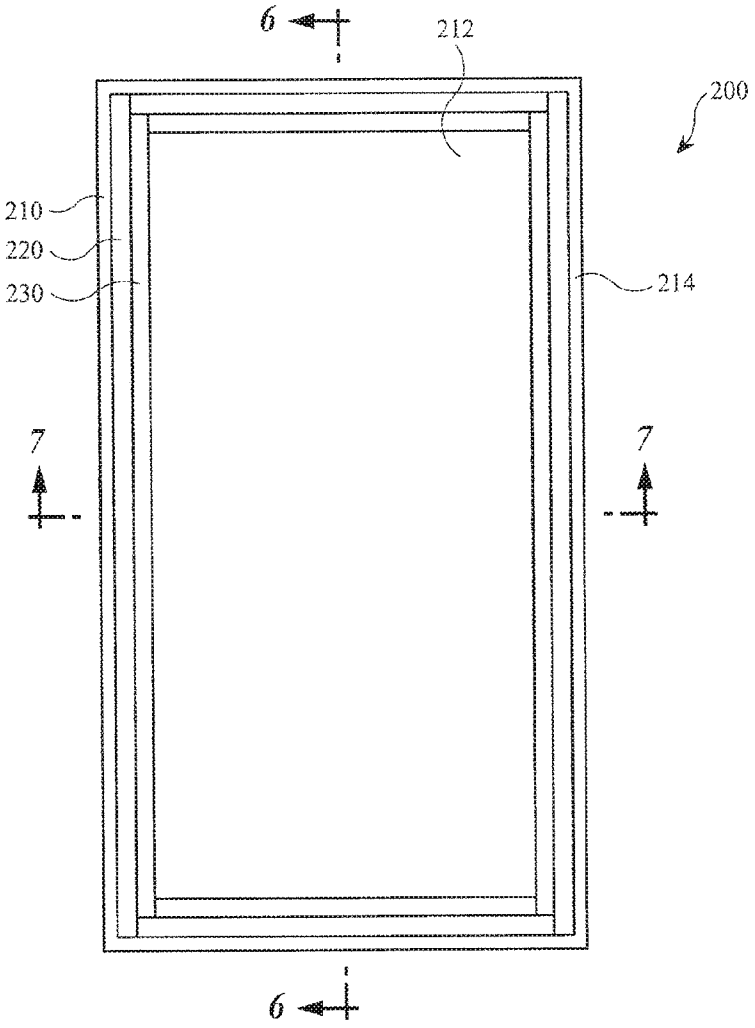
FIG. 5 shows a bottom view of a double collar lid according to some embodiments.
Figure 7:
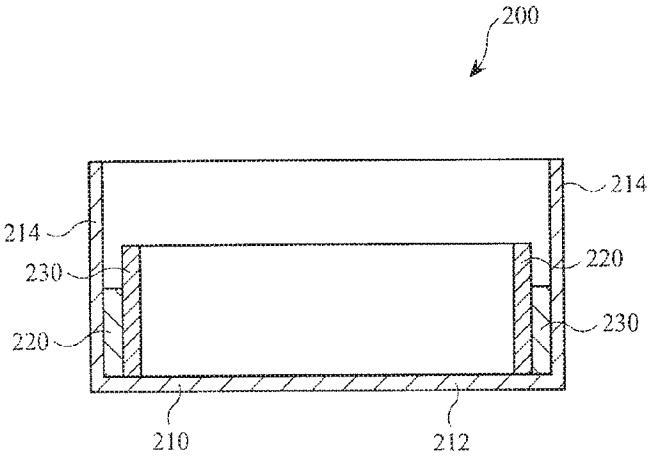
FIG. 7 shows a front cross-section view of the double collar lid of FIG. 5 at line 7-7 according to some embodiments.
Figure 6:
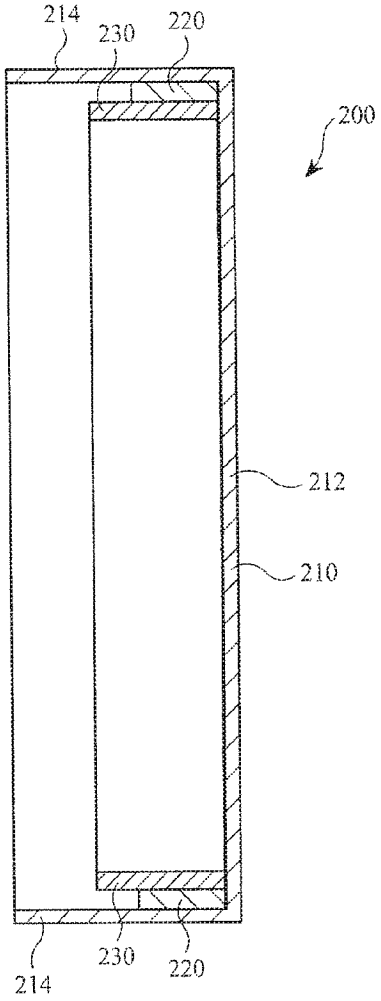
FIG. 6 shows a side cross-section view of the double collar lid of FIG. 5 at line 6-6 according to some embodiments.
Figure 8:
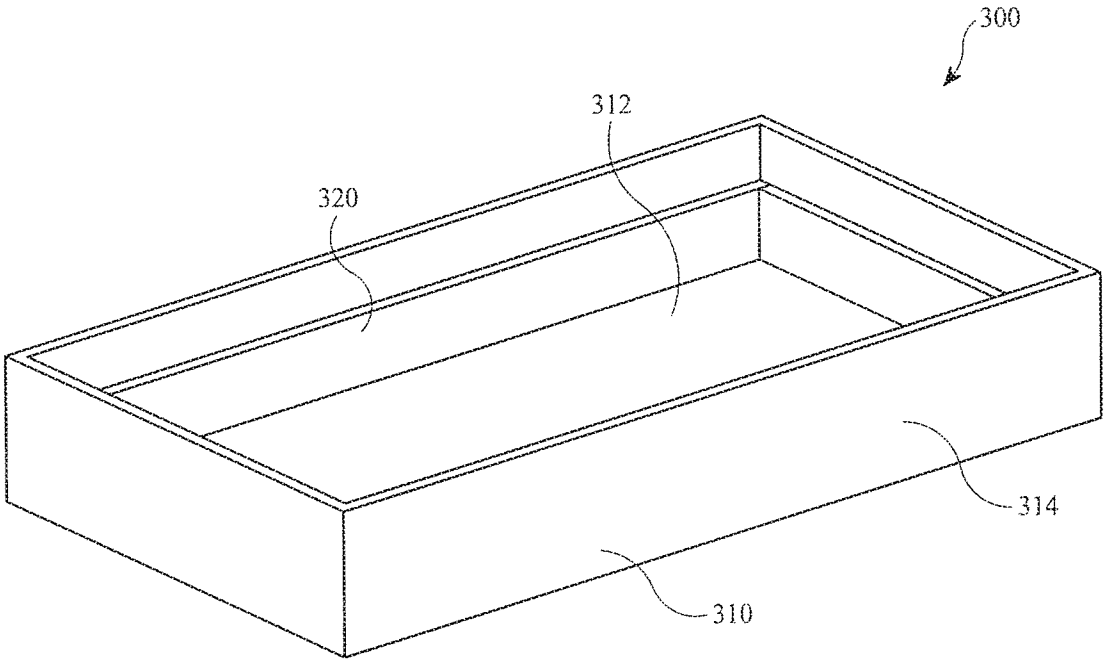
FIG. 8 shows a perspective view of a base box according to some embodiments.
Figure 9:
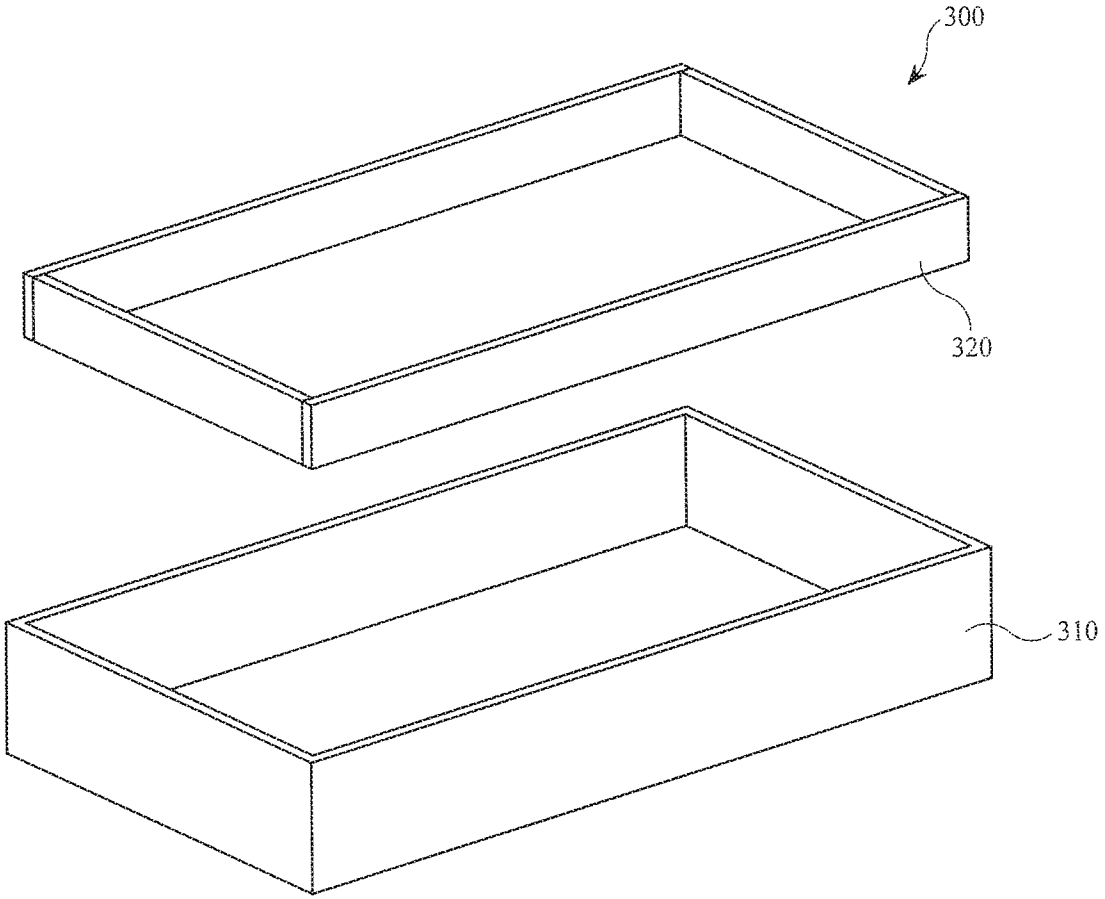
FIG. 9 shows an exploded view of a base box according to some embodiments.
Figure 10:
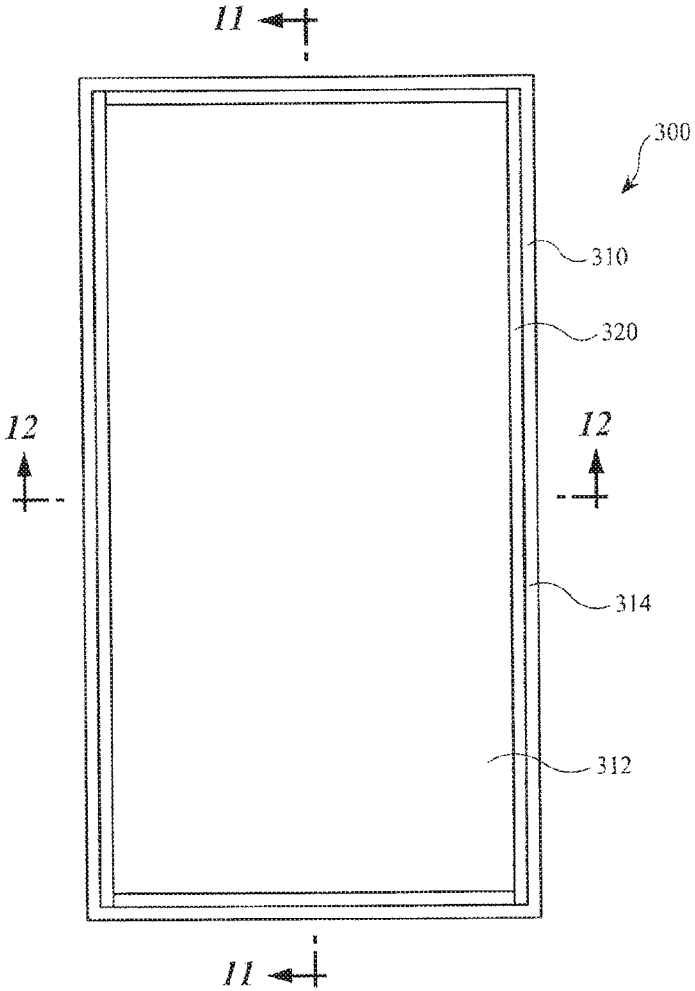
FIG. 10 shows a top view of a base box according to some embodiments.
Figure 12:
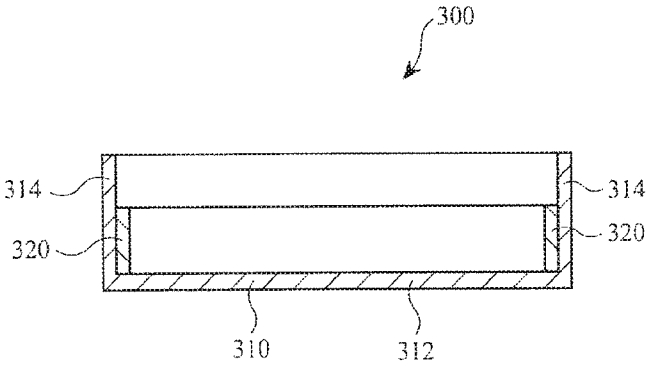
FIG. 12 shows a front cross-section view of the base box of FIG. 10 at line 12-12 according to some embodiments.
Figure 11:
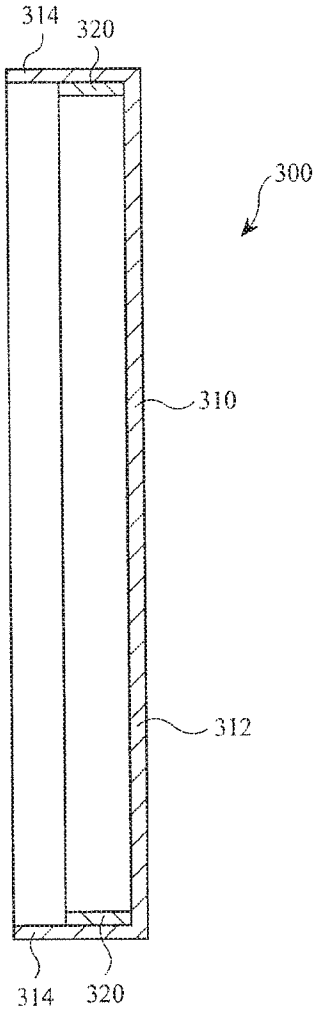
FIG. 11 shows a side cross-section view of the base box of FIG. 10 at line 11-11 according to some embodiments.

In some embodiments, packaging 100 includes a lid 200, a base box 300, and a tray 400, as shown, for example, in FIGS. 1 and 2. Tray 400 supports an electronic device 500. In some embodiments, tray 400 supports electronic device 500 to be raised relative to a bottom of base box 300. In some embodiments, an available area for the electronic device is at least partially disposed above a top of the base.

According to some embodiments, a portion of electronic device 500 is disposed above the top of base box 300. For example, at least one third of electronic device 500 may be disposed above the top of base box 300. In other embodiments, at least half of electronic device 500 is disposed above the top of base box 300. In other embodiments, at least two thirds of electronic device 500 is disposed above the top of base box 300.

With tray 400 supporting electronic device 500 such that a portion of electronic device 500 is disposed above the top of base box 300, electronic device 500 is immediately presented to a consumer upon opening packaging 100. In addition, electronic device 500 is easily accessible. For example, a consumer has no need to reach into a constrained space of base box 300 to remove electronic device 500.

Lid 200, according to some embodiments, comprises an outer portion 210, a first collar 220, and a second collar 230, as shown in FIGS. 3-7. Lid 200 may also include a protective layer 240, which may be formed of a nonwoven material. Outer portion 210 includes a top 212 and sides 214. Outer portion 210 may include any number of sides 214. For example, if packaging 100 is a rectangular box, outer portion 210 includes four sides 214.

According to some embodiments, sides 214 have a height that is taller than first collar 220 and second collar 230, as shown, for example, in FIG. 2. In some embodiments, sides 214 have a height that is at least as tall as the combined heights of base box 300 and first collar 220 so that when lid 200 is on base box 300 the bottom of sides 214 are either flush with the bottom of base box 300 or extend beyond the bottom of base box 300. Sides 214 are disposed on the outside of base box 300 when lid 200 is on base box 300. In some embodiments, the height of one or both of first collar 220 and second collar 230 is at least half the height of sides 214. In some embodiments, the height of one or both of first collar 220 and second collar 230 is at least two thirds the height of sides 214.

In some embodiments, outer portion 210 is composed of paper materials. For example, outer portion 210 may be composed of layers of solid bleached sulphite (SBS) and grey board. In some embodiments, outer portion 210 includes a layer of grey board within two layers of SBS. According to some embodiments, a layer of finish paper is disposed on the outside of outer portion 210 to provide a desired look and feel for packaging 100. Some embodiments of outer portion 210 may also include a biaxially oriented polypropylene (BOPP) matte film for lamination.

In some embodiments, protective layer 240 is disposed on an inside surface of top 212. In some embodiments, top 212 comprises protective layer 240. In other embodiments, protective layer 240 may be adhered to the inside surface of top 212 with an adhesive. Protective layer 240 may be glued in a manner to avoid any wrinkles in the material after assembly. Protective layer 240 may be a layer of nonwoven material that protects electronic device 500 by reducing scratching of electronic device 500. Protective layer 240 may also include a layer of SBS.

According to some embodiments, first collar 220 is disposed on an inner surface of sides 214. In some embodiments, first collar 220 is adhered to the inner surface of sides 214 with an adhesive. First collar 220 may also be disposed adjacent to top 212 or protective layer 240. For example, first collar 220 may be in contact with either top 212 or protective layer 240.

In some embodiments, first collar 220 has a height that is shorter than second collar 230. First collar 220 is configured to abut base box 300 when lid 200 is on base box 300, as in FIG. 2. Thus, first collar 220 may have a height equal to a distance between an inner surface of top 212 of outer portion 210 and a top surface of a side 314 of base box 300. In some embodiments, the height of first collar 220 defines the available area for electronic device 500 that is disposed above a top of the base.

According to some embodiments, first collar 220 includes a separate piece for each side 214 of outer portion 210. For example, when packaging 100 is a rectangular box, first collar 220 includes two shorter pieces and two longer pieces. When each piece is adhered to the appropriate side 214, the pieces combine to form first collar 220.

First collar 220, according to some embodiments, is composed of paper materials. For example, first collar 220 may be composed of layers of clay coated news back (CCNB), grey board, and finish paper. In some embodiments, first collar 220 includes one layer of CCNB, one layer of grey board, and one layer of finish paper.

According to some embodiments, second collar 230 is disposed on an inner surface of first collar 220. In some embodiments, second collar 230 is adhered to the inner surface of first collar 220 with an adhesive. Second collar 230 may also be disposed adjacent to top 212 or protective layer 240. For example, second collar 230 may be in contact with either top 212 or protective layer 240.

In some embodiments, second collar 230 has a height that is taller than first collar 220. For example, the height of first collar 220 may be less than three-fourths the height of collar 230, or less than one-half the height of collar 230. Second collar 230 may be configured to be disposed on an inside of base box 300 when lid 200 is on base box 300, as in FIG. 2. In some embodiments, second collar 230 extends from top 212 to tray 400. Thus, second collar 230 may have a height equal to a distance between an inner surface of top 212 of outer portion 210 and a top surface of tray 400. In some embodiments, the relationship between the height of first collar 220 and the height of second collar 230 reflects the relationship between the amount of available area for electronic device 500 that is disposed above the top of base box 300 and the amount of available area for electronic device 500 that is disposed below the top of base box 300. In some embodiments, second collar 230 extends from top 212 to near tray 400, but does not contact tray 400.

According to some embodiments, second collar 230 includes a separate piece for each side 214 of first collar 220. For example, when packaging 100 is a rectangular box, second collar 230 includes two shorter pieces and two longer pieces. When each piece is adhered to the appropriate side of first collar 220, the pieces combine to form second collar 230.

Second collar 230, according to some embodiments, is composed of paper materials. For example, second collar 230 may be composed of layers of CCNB, grey board, and finish paper. In some embodiments, first collar 220 includes one layer of CCNB, one layer of grey board, and one layer of finish paper. In some embodiments, an innermost side of second collar 230 is formed of a protective material, which may be softer than other materials forming lid 200 or second collar 230. For example, the innermost side of second collar 230 may be formed of microfiber (e.g., a microfiber layer) or another type of nonwoven material.

First collar 220 and second collar 230, according to some embodiments, have the same thickness. In other embodiments, the thickness of first collar 220 and second collar 230 differ. The thickness of each of first collar 220 and second collar 230 may be thicker than the thickness of a side 314 of base box 300. One or both of first collar 220 and second collar 230 may have a thickness of at least two millimeters. One or both of first collar 220 and second collar 230 may have a thickness of at least three millimeters. In some embodiments first collar 220 may have the same or greater thickness as the thickness of a side 314 of base box 300, such that side 314 of base box 300 can fit between side 214 of lid 200 and second collar 230.

According to some embodiments, first collar 220 and second collar 230 fill in space between sides 214 and electronic device 500. Thus, second collar 230 may be closely adjacent to the sides of electronic device 500 (e.g., spaced apart by less than 2 millimeters, for example, 1 millimeter or less, or 0.5 millimeters or less). Closely adjacent, as used herein, means close enough to constrain movement, but not necessarily touching when packaging 100 is upright. Thus, here, second collar 230 does not touch electronic device 500 when packaging 100 is lying upright on a flat surface. But if packaging 100 is dropped or turned to the side, second collar 230 will constrain appreciable movement of electronic device 500 so that electronic device 500 maintains its original position when returned to the upright position.

In some embodiments, because first collar 220 abuts base box 300, first collar 220 defines the distance between an inner surface of top 212 and the top of base box 300 and thus defines the available area for electronic device 500 that is disposed above the top of base box 300. In some embodiments, the portion of electronic device 500 that is disposed above base box 300 has a height that is approximately the same as the height of first collar 220, thus using the full height of available area for electronic device 500 that is disposed above the top of base box 300. In some embodiments, top 212 is closely adjacent to the highest point of electronic device 500 (e.g., spaced apart by less than 2 millimeters, for example, 1 millimeter or less, or 0.5 millimeters or less). Top 212 therefore does not necessarily touch electronic device 500 when packaging 100 is lying upright on a flat surface. But if packaging 100 is dropped or turned upside down, top 212 will constrain movement of electronic device 500 so that electronic device 500 maintains its original position when returned to the upright position.

Base box 300, according to some embodiments, comprises an outer portion 310 and a collar 320, as shown, for example in FIGS. 8-12. Outer portion 310 may include a bottom 312 and sides 314. The shape of outer portion 310 mirrors the shape of outer portion 210, but with slightly smaller dimensions so that sides 214 will be disposed on the outside of sides 314 when lid 200 is on base box 300. Sides 214 may provide a hard stop for lid 200 by abutting with first collar 220.

In some embodiments, outer portion 310 is composed of paper materials. For example, outer portion 310 may be composed of layers of SBS and grey board. In some embodiments, outer portion 310 includes a layer of grey board within two layers of SBS. According to some embodiments, a layer of finish paper is disposed on the outside of outer portion 310 to provide a desired look and feel for packaging 100. Some embodiments of outer portion 310 may also include a biaxially oriented polypropylene (BOPP) matte film for lamination.

According to some embodiments, collar 320 is disposed on an inner surface of sides 314. In some embodiments, collar 320 is adhered to the inner surface of sides 314 with an adhesive. Collar 320 may also be disposed adjacent to bottom 312. For example, collar 320 may be in contact with bottom 312.

Figure 16:
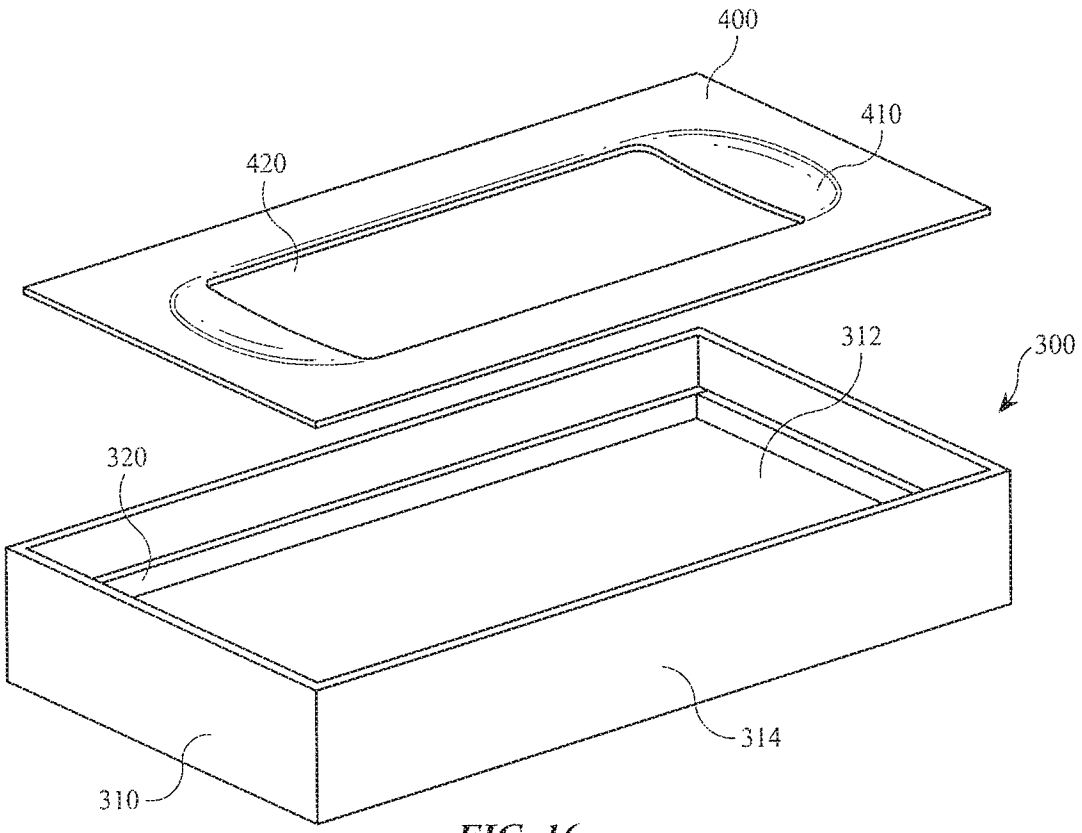
FIG. 16 shows an exploded view of a tray and a base box according to some embodiments.
Figure 17:
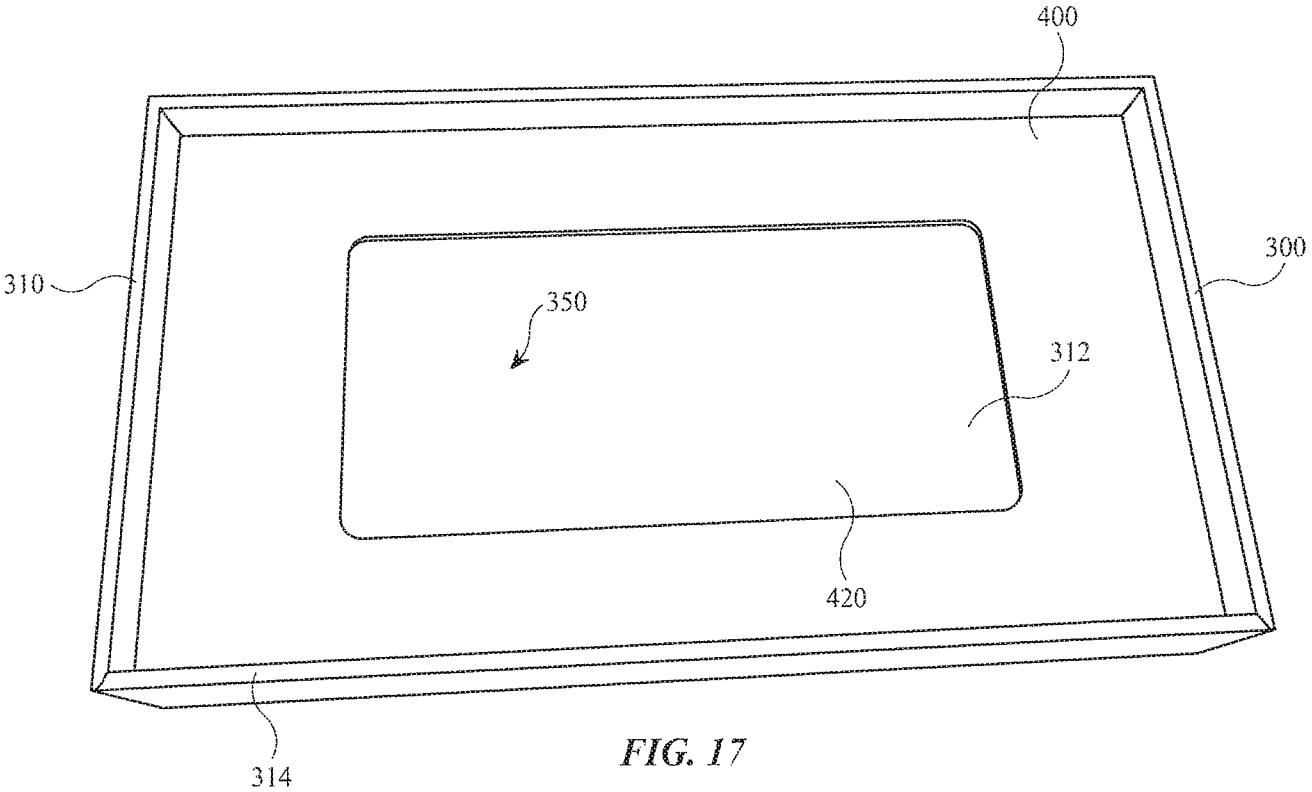
FIG. 17 shows a top perspective view of a tray in a base box according to some embodiments.
Figure 18:
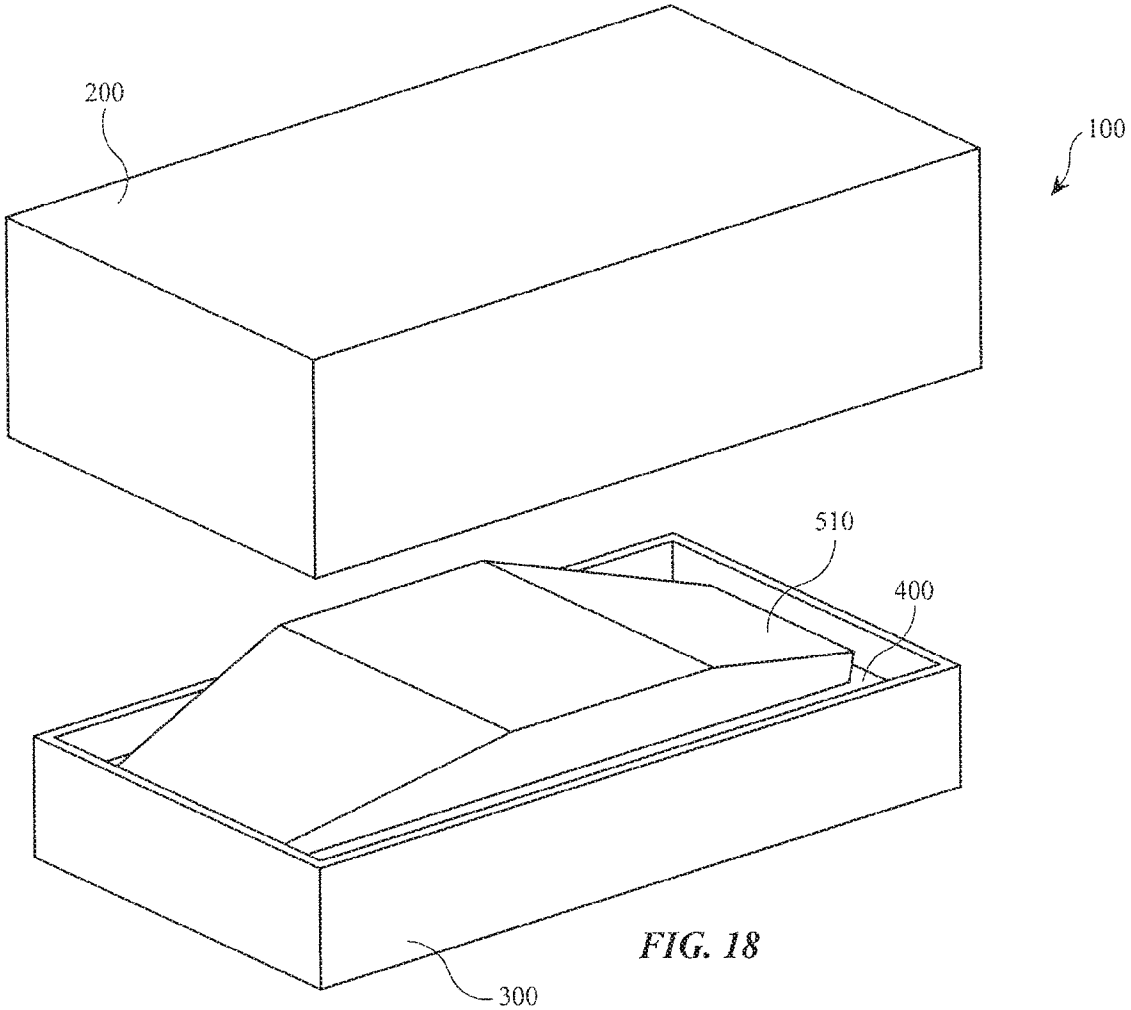
FIG. 18 shows a perspective view of packaging with a double collar lid according to some embodiments.
Figure 19:
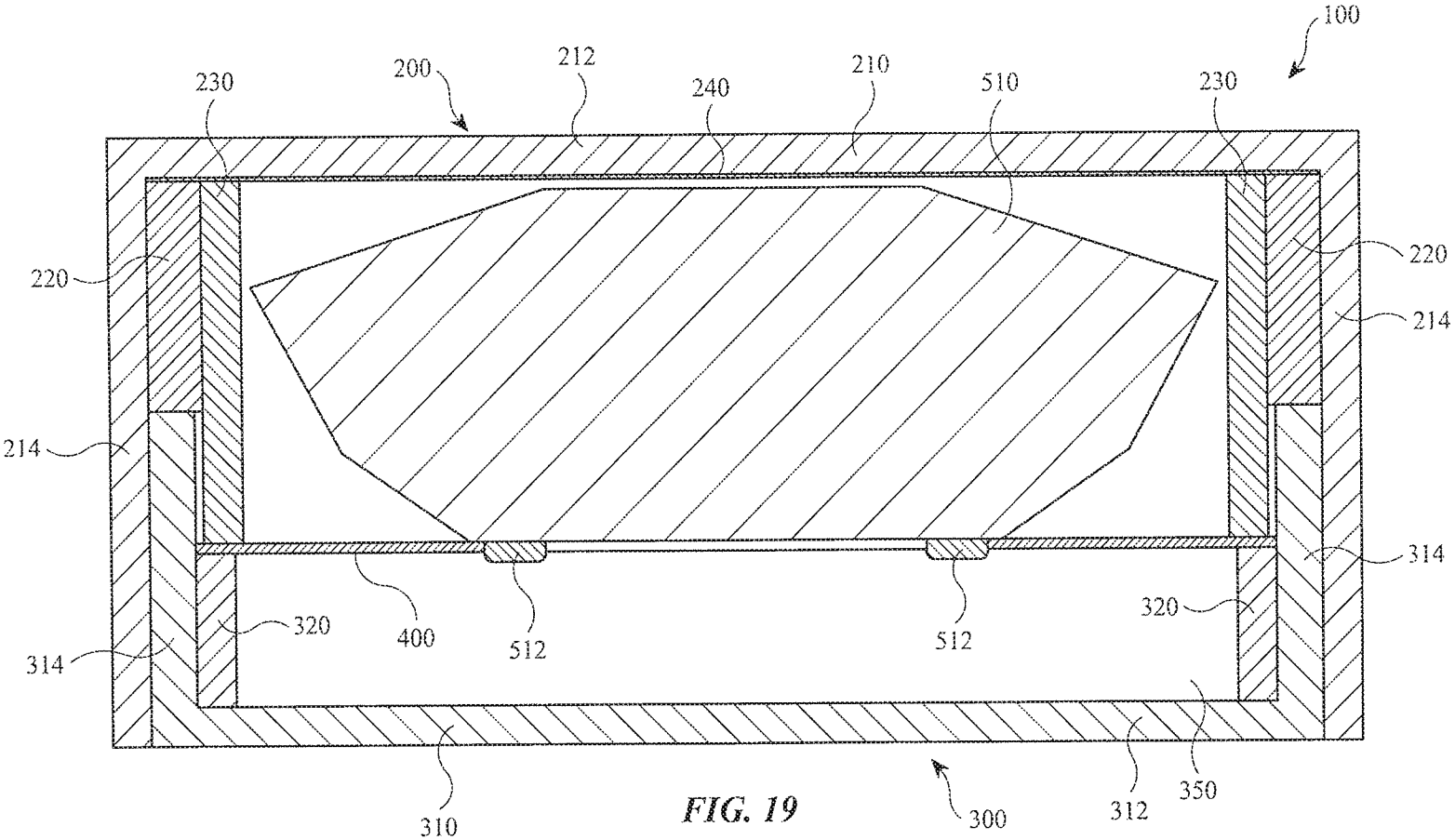
FIG. 19 shows a cross-section view of packaging with a double collar lid according to some embodiments.
Figure 20:
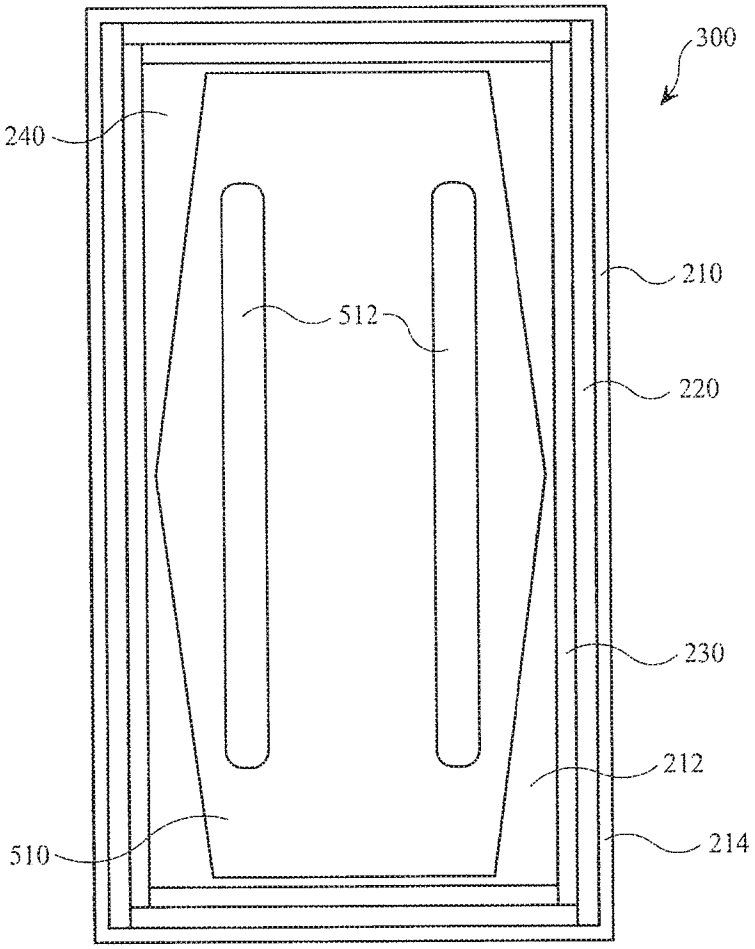
FIG. 20 shows a bottom view of a double collar lid with a product according to some embodiments.

In some embodiments, collar 320 supports tray 400, as shown, for example, in FIGS. 16 and 17. Accordingly, the height of collar 320 affects the portion of electronic device 500 that is disposed above the base box. In some embodiments, the height of collar 320 is at least half the height of sides 314. In some embodiments, the height of collar 320 is at least two thirds the height of sides 314. In some embodiments, the height of collar 320 is only slightly less than the height of sides 314 such that when tray 400 is supported by collar 320, tray 400 is just below the top of sides 314.

In some embodiments, the configuration of first collar 220, second collar 230, and collar 320 is such that the distance between an inner surface of top 212 of outer portion 210 and a top surface of tray 400 is at least twice the distance between the top of sides 314 and a top surface of tray 400. For example, the distance between an inner surface of top 212 of outer portion 210 and a top surface of tray 400 may be at least three, four, or five times the distance between the top of sides 314 and a top surface of tray 400.

Collar 320, according to some embodiments, is composed of paper materials. For example, collar 320 may be composed of layers of paper (e.g., finish paper and CCNB). In some embodiments, first collar 220 includes one layer of finish paper and one layer of CCNB.

Figure 13:
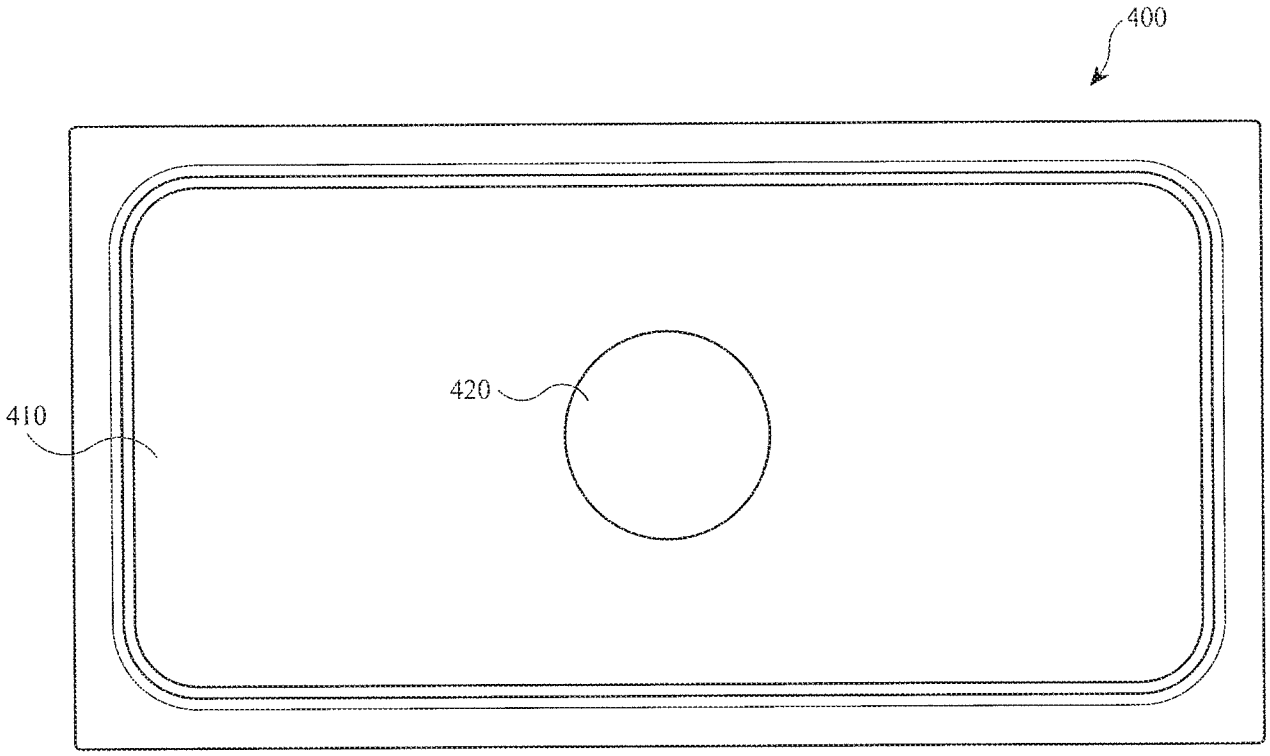
FIG. 13 shows a tray according to some embodiments.
Figure 14:
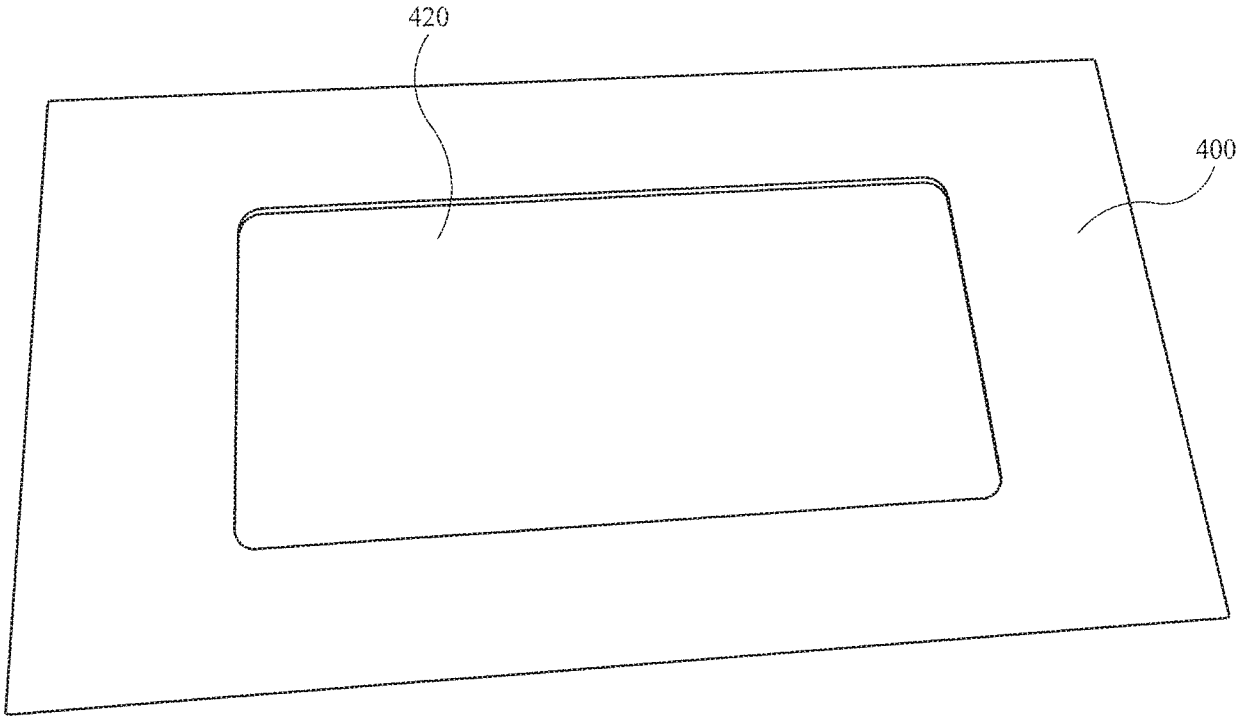
FIG. 14 shows a tray according to some embodiments.
Figure 15:
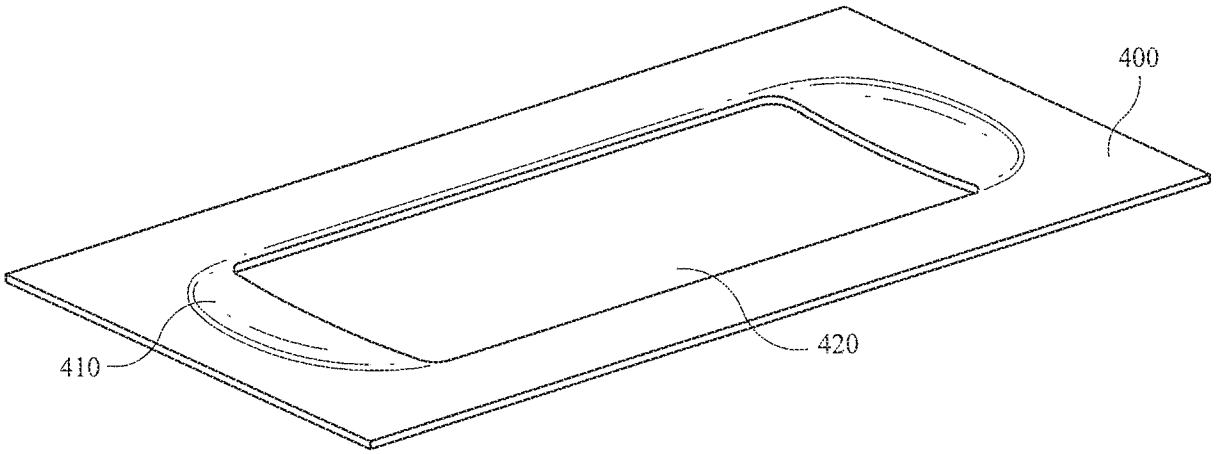
FIG. 15 shows a tray according to some embodiments.

Tray 400, according to some embodiments, is supported by collar 320 and is configured to support electronic device 500. In some embodiments, tray 400 includes an inset portion 410 shaped and sized to support electronic device 500. Inset portion 410 is the designated placement for electronic device 500. Thus, in some embodiments, inset portion 410 defines a part of the available area for electronic device 500. Some embodiments of tray 400 include an aperture 420 within inset portion 410, as shown, for example, in FIGS. 13 and 15. Other embodiments do not include an aperture 420 in tray 400. Some embodiments of tray 400 have an aperture 420 instead of or in addition to an inset portion 410, as shown, for example, in FIGS. 14, 15, 16, and 19.

According to some embodiments, tray 400 provides a frame surrounding electronic device 500 when lid 200 is removed from base box 300. When tray 400 is supported on collar 320, tray 400 and base box 300 form a cavity 350. According to some embodiments, manuals, supporting accessories, and other parts may be disposed within cavity 350. Tray 400 may comprise a molded fiber tray.

Figure 21:
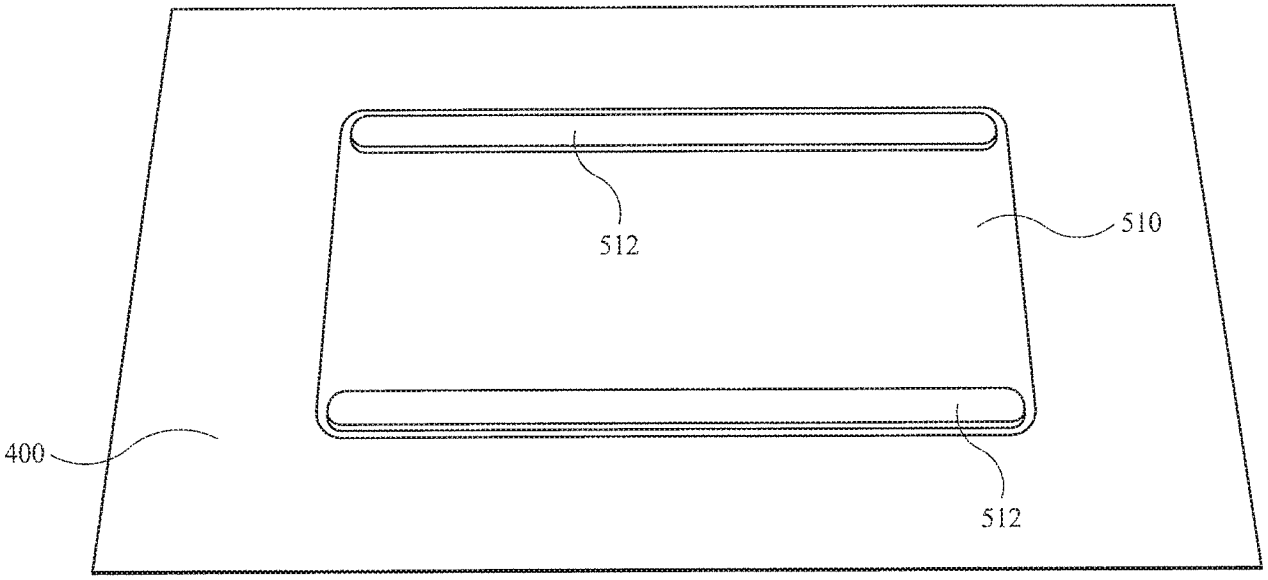
FIG. 21 shows a tray with a product according to some embodiments.

According to some embodiments, electronic device 500 comprises an electronic device 510 (e.g., a computer mouse, phone, a tablet, a computer, or a watch), as shown, for example, in FIGS. 18-21. In some of these embodiments, tray 400 comprises an aperture 420. Aperture 420 may be configured to receive feet 512 of electronic device 510, as shown in FIG. 21. Aperture 420 may help hold electronic device 510 in place in conjunction with features of lid 200 with first collar 220 and second collar 230 as described above. For example, the above-described features of lid 200 may help hold electronic device 510 in place and distribute forces that may be applied to electronic device 510 during handling.

The foregoing descriptions of the specific embodiments described herein are presented for purposes of illustration and description. These exemplary embodiments are not intended to be exhaustive or to limit the embodiments to the precise forms disclosed. All specific details described are not required in order to practice the described embodiments.

It will be apparent to one of ordinary skill in the art that many modifications and variations are possible in view of the above teachings, and that by applying knowledge within the skill of the art, one may readily modify and/or adapt for various applications such specific embodiments, without undue experimentation, without departing from the general concept of the present invention. Such adaptations and modifications are intended to be within the meaning and range of equivalents of the disclosed embodiments, based on the teaching and guidance presented herein.

The detailed description section is intended to be used to interpret the claims. The summary and abstract sections may set forth one or more but not all exemplary embodiments of the present invention as contemplated by the inventor(s), and thus, are not intended to limit the present invention and the claims.

The present invention has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The phraseology or terminology used herein is for the purpose of description and not limitation, such that the terminology or phraseology of the present specification is to be interpreted by the skilled artisan.

The breadth and scope of the present invention should not be limited by any of the above-described exemplary embodiments, but should be defined in accordance with the claims and their equivalents.

What is claimed is:

1. A package for an electronic device comprising:

a base;

a tray disposed within the base and configured to support the electronic device to be raised relative to a bottom of the base, wherein an available area for the electronic device is disposed above a top of the base; and a lid comprising an outer portion and a first inner collar configured to constrain the position of the electronic device within the available area such that when the lid is removed from the base the electronic device is framed by the tray, wherein the tray and the base form a cavity underneath the tray.

2. The package of claim 1, wherein at least one half of the available area for the electronic device is disposed above the top of the base.

3. The package of claim 1, wherein the outer portion comprises a top, and wherein the distance between the top of the outer portion and the tray is at least twice the distance between the top of the base and the tray.

4. The package of claim 1, wherein the outer portion comprises a top, and wherein a distance between the top of the outer portion and the tray is equal to a height of the first inner collar.

5. The package of claim 1, further comprising a second inner collar disposed between the outer portion and the first inner collar.

6. The package of claim 5, wherein the outer portion comprises a top, and wherein a distance between the top of the outer portion and the top of the base is equal to a height of the second inner collar.

7. The package of claim 5, wherein at least one of the first and second inner collars comprises a thickness that is equal to or greater than a thickness of a side of the base.

8. The package of claim 5, wherein each of the first and second inner collars comprises a thickness, and wherein the thickness of one of the first and second inner collars is at least two millimeters.

9. The package of claim 5, wherein the first inner collar is configured to horizontally constrain the position of the electronic device and the second inner collar comprises a vertical stop for the lid with respect to the base.

10. The package of claim 1, wherein the first inner collar comprises a height that is at least half of a height of a side of the base.

11. The package of claim 1, wherein the first inner collar is configured to constrain the position of the electronic device as the lid is being removed from the base.

12. A packaged electronic device comprising:

the package of claim 1; and the electronic device, wherein the electronic device is a computer mouse.

13. A packaged electronic device comprising:

the package of claim 1; and the electronic device, wherein the electronic device is a phone.

14. A packaged electronic device comprising:

the package of claim 1; and the electronic device, wherein the electronic device is closely adjacent to the first inner collar.

15. A packaged electronic device comprising:

the package of claim 1; and the electronic device, wherein the outer portion comprises a top, and wherein the electronic device is closely adjacent to the top.

16. A lid comprising:

a top;

a side wall connected to the top;

a first collar disposed on an inner surface of the side wall adjacent to the top; and a second collar disposed on an inner surface of the first collar adjacent to the top, wherein the second collar extends further away from the top than the first collar.

17. The lid of claim 16, wherein the side wall comprises four side wall segments.

18. The lid of claim 16, wherein the first collar is adhered to the inner surface of the side wall.

19. The lid of claim 16, wherein the second collar is adhered to the inner surface of the first collar.

20. The lid of claim 16, wherein the side wall extends further away from the top than does the second collar.

21. The lid of claim 16, wherein the first collar is in contact with the top.

22. The lid of claim 16, wherein the second collar is in contact with the top.

23. A package for an electronic device comprising:

a base; and a lid configured to interface with the base to close the package, the lid comprising:

a top;

a side wall connected to the top, wherein the side wall is disposed on an outside of the base when the package is closed;

a first collar disposed on an inner surface of the side wall adjacent the top, wherein the first collar abuts the base when the package is closed; and a second collar disposed on an inner surface of the first collar adjacent the top, wherein the second collar is disposed on an inside of the base when the package is closed.

24. The package of claim 23, wherein the side wall extends to a bottom of the base when the package is closed.

25. The package of claim 23, further comprising a layer of protective material forming an inner surface of the top.

26. The package of claim 23, further comprising the electronic device disposed within the package, wherein the second collar is configured to constrain the position of the electronic device when the package is closed.

* * * * *